United States Patent [19]

MacLeod

[11] Patent Number: 4,765,110

[45] Date of Patent: Aug. 23, 1988

[54] ADJUSTABLE PLASTIC SHUTTER

[75] Inventor: Richard J. MacLeod, Milford, Mich.

[73] Assignee: Tapco Products Company, Inc., Detroit, Mich.

[21] Appl. No.: 421,818

[22] Filed: Sep. 23, 1982

[51] Int. Cl.[4] ..... E06B 7/08

[52] U.S. Cl. ..... 52/473

[58] Field of Search ..... 52/822, 823, 473, 455, 52/314, 98

[56] References Cited

U.S. PATENT DOCUMENTS

| | | | |
|---|---|---|---|
| 3,055,467 | 9/1962 | Peek | 52/473 |
| 3,086,442 | 4/1963 | Waldron | 52/473 |
| 3,191,242 | 6/1965 | Rauen | 52/473 |
| 3,455,079 | 7/1969 | Frederick | 52/473 |
| 3,797,186 | 3/1974 | Smith | 52/314 |
| 3,802,146 | 4/1974 | Tacke | 52/823 |
| 3,936,985 | 2/1976 | Marulli | 52/98 |
| 3,968,738 | 7/1976 | Matzke | 52/473 |
| 4,251,966 | 2/1981 | Foltman | 52/473 |

*Primary Examiner*—John E. Murtagh

*Attorney, Agent, or Firm*—Barnes, Kisselle, Raisch, Choate, Whittemore & Hulbert

[57] ABSTRACT

An adjustable length shutter assembly of molded plastic modular construction comprising a pair of side rails which may be cut to desired length, one or more shutter panels slidably received within parallel double-channel tracks extending along the opposing side rails, and upper and lower end rails extending between the side rails and capturing the shutter panels in assembly. In a preferred embodiment of the invention, at least two shutter panels are carried between the shutter side rails and are separated from each other by a mullion piece. In accordance with one important feature of the present invention, the end rails and the mullion piece are so constructed as to overlap the edges of the side rails and shutter panels which are adapted to be adjustably trimmed during the installation process so as to reduce fading and structural deterioration at the cut edges due to exposure to ultraviolet solar radiation. Another feature of the invention contemplates an improved structural connection between the end rails and side rails, which not only overlaps the cut edges of the end rails as previously described, but also enhances structural rididdity of the overall shutter assembly during and following installation.

14 Claims, 4 Drawing Sheets

14
92
80
90
72
16
78
10
12
-66-
70
68
4
94
76
82
74
112
32
42
40
20
26
44
46
62
-56-
24
68
64
66
52
54
48
50
22
101
106
-98-
104
94
110
102
18
108

34
68
60
66
28
30
12
14
26
32
24
56

FIG. 8
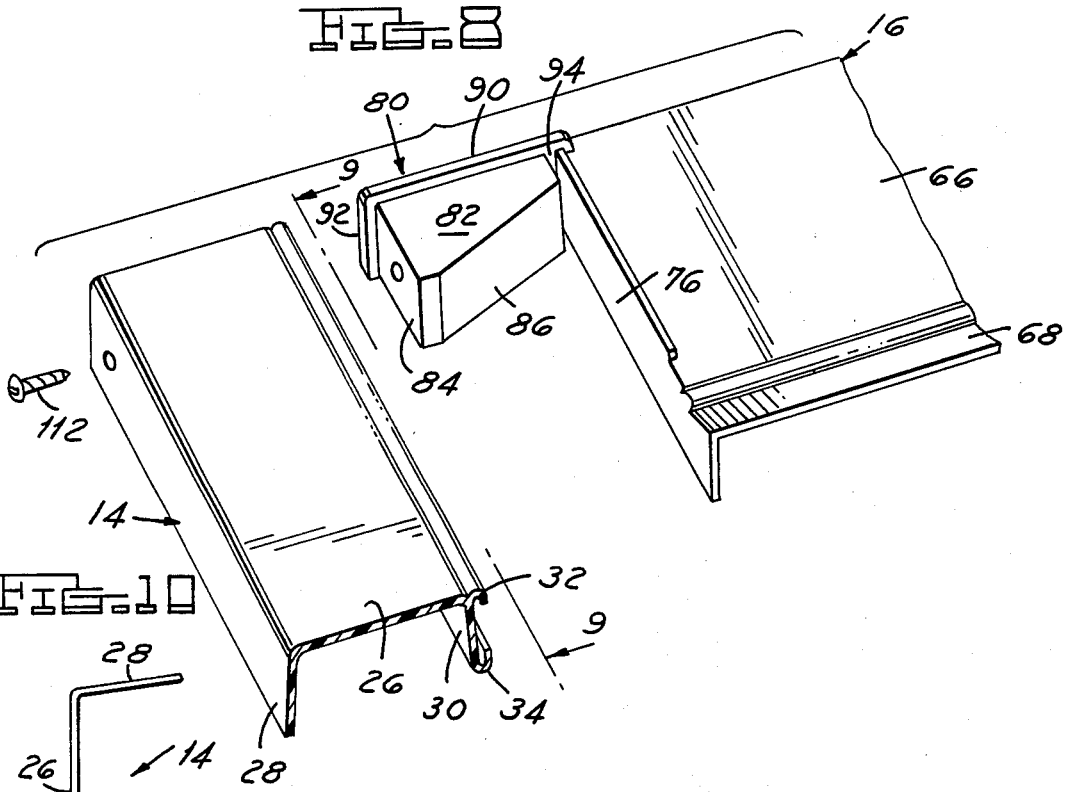
FIG. 10
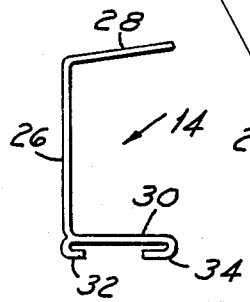
FIG. 11
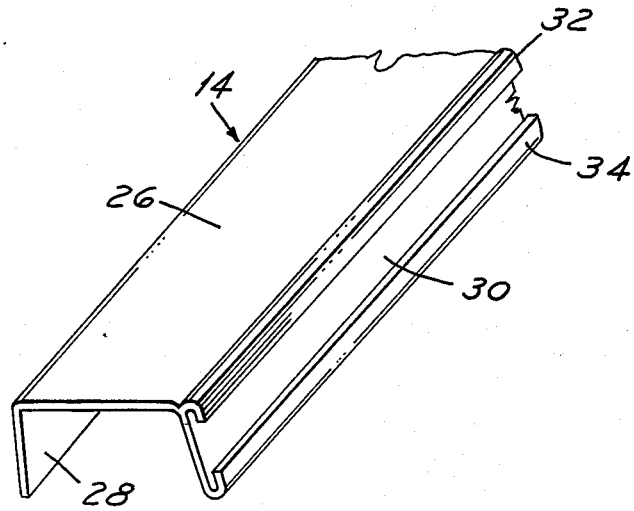
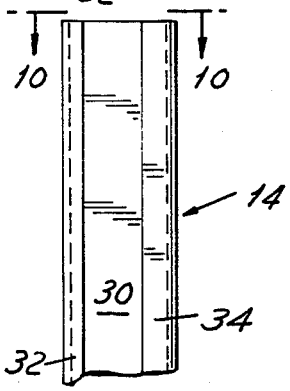
FIG. 9

ADJUSTABLE PLASTIC SHUTTER

The present invention relates to simulated woodgrain shutters of molded plastic construction, and more particularly to multiple-piece shutter assemblies which include facility for adjusting shutter length.

BACKGROUND OF THE INVENTION

Adjustable length louver and panel shutters, including specifically shutters of modular rigid molded plastic construction, have heretofore been proposed in the art. The Foltman U.S. Pat. No. 4,251,966 discloses such a shutter as comprising a pair of extruded side rails having respective single-channel tracks disposed in opposition. Louvered panels are injection molded with integral side runners which are slidably received in the opposing tracks. Upper and lower cross pieces are fastened to the side rails by fasteners to hold the panels in place. The modular pieces are precoated to filter ultraviolet radiation and thereby prevent fading and deterioration.

The Frederick U.S. Pat. No. 3,455,079 shows an adjustable length shutter comprising a one-piece louver panel with integral side rails and separate end cross pieces or rails. See also the U.S. Pat. Nos. 3,191,242, to Rauen, 3,797,186 to Smith and 3,968,738 to Matzke.

One problem with many adjustable length shutter assemblies of the prior art is a requirement for complex cutting or trimming operations for tailoring overall length at the installation site. The side rails in Foltman, for example, are cut to length in a stepped, rather than a planar, configuration. In Federick, the integral panel and side rails must be trimmed to length and then slotted to receive the end rails. Another problem is that although the panels and rails are initially coated at the factory to screen ultraviolet solar radiation, edges which are cut in the field may be exposed to radiation, resulting in unsightly fading and possible structural deterioration.

OBJECTS AND SUMMARY OF THE INVENTION

An object of the present invention is to provide a modular shutter assembly which may be readily adjusted to length at the installation site by relatively unskilled personnel without requiring any complex or difficult cutting or trimming operations.

Another object of the invention is to provide a modular shutter assembly which is so constructed as to protect cut edges against exposure to ultraviolet radiation.

A further object of the invention is to provide a modular shutter assembly which not only satisfies the foregoing design objectives, but also is rigid and durable during and after the installation process.

The foregoing and other objects are accomplished in accordance with the present invention by providing an adjustable length shutter assembly of molded plastic modular construction comprising a pair of side rails which may be cut to desired length, one or more shutter panels slidably received within parallel double-channel tracks extending along the opposing side rails, and upper and lower end rails extending between the side rails and capturing the shutter panels in assembly. In a preferred embodiment of the invention, at least two shutter panels are carried between the shutter side rails and are separated from each other by a mullion piece. In accordance with one important feature of the present invention, the end rails and the mullion piece are so constructed as to overlap the edges of the side rails and shutter panels which are adapted to be adjustably trimmed during the installation process so as to reduce fading and structural deterioration at the cut edges due to exposure to ultraviolet solar radiation. Another feature of the invention contemplates an improved structural connection between the end rails and side rails which not only overlaps the cut edges of the end rails as previously described, but also enhances structural rigidity of the overall shutter assembly during and following installation.

BRIEF DESCRIPTION OF THE DRAWINGS

The foregoing and other objects, features and advantages of the present invention will be best understood from the following description, the appended claims and the accompanying drawings in which:

FIG. 8 is a fragmentary explosed perspective view of a portion of the shutter assembly in accordance with the invention illustrating details of the side rail to end rail connection;

FIG. 9 is a fragmentary side elevational view taken from the direction 9—9 in FIG. 8;

FIG. 10 is an end elevational view taken from the direction 10—10 in FIG. 9;

FIG. 11 is a fragmentary perspective view of a lower end of the side rail shown in FIGS. 8–10;

DETAILED DESCRIPTION OF PREFERRED EMBODIMENTS

Figures 1, 2, 4, 5, 6:
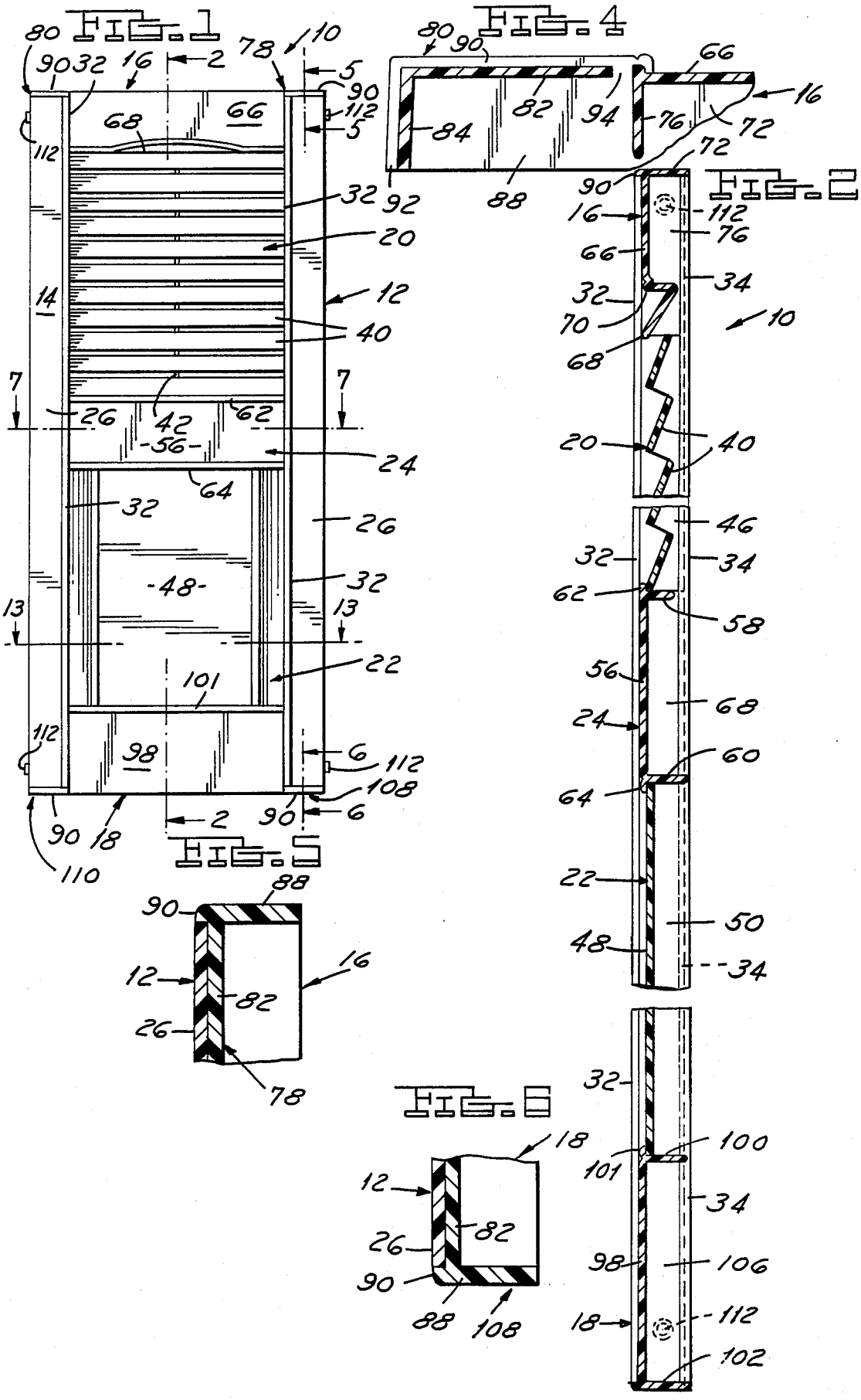
FIG. 1 is a front elevational view of one presently preferred embodiment of a shutter assembly in accordance with the present invention.
FIG. 2 is a side sectional view taken substantially along the line 2—2 in FIG. 1.
FIG. 4 is a fragmentary sectional view taken substantially along the line 4—4 in FIG. 3.
FIGS. 5–7 are fragmentary sectional views taken substantially along the respective lines 5—5, 6—6 and 7—7 in FIG. 1.

FIGS. 1–11 and 13–14 illustrate a presently preferred embodiment 10 of the shutter assembly in accordance with the present invention as comprising a pair of laterally spaced side rails 12, 14, upper and lower end rails 16, 18, and a pair of shutter panels 20, 22 carried between side rails 12, 14 and separated from each other by a mullion piece 24. Side rail 14 comprises a front wall 26 and a pair of laterally spaced generally parallel flanges 28, 30 projecting integrally rearwardly from side edges of front wall 26 to form an open generally C-shaped side rail cross section. A pair of channels are formed by inwardly and oppositely turned flanges 32, 34 extending along the front and rear edges of inside rail wall 30 to provide a flat track extending entirely along the side rail. Side rail 12 is a mirror image of rail 14 described in detail hereinabove.

Figure 13:
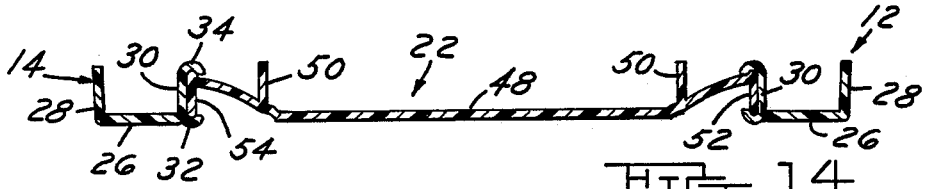
FIG. 13 is a sectional view taken along the line 13—13 in FIG. 1.
Figure 14:
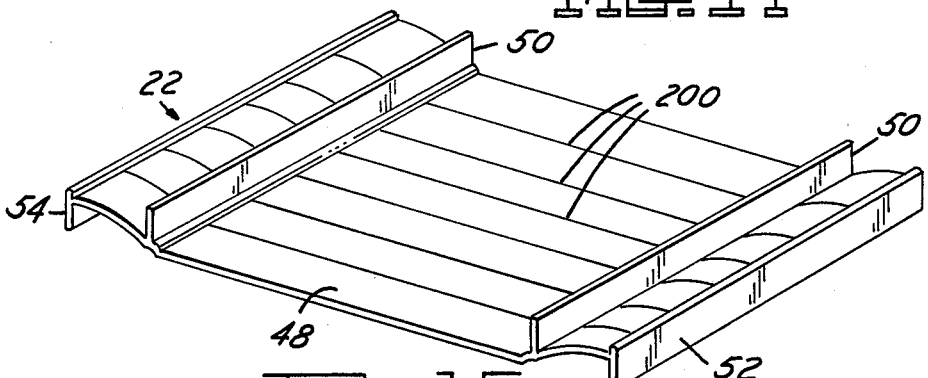
FIG. 14 is a rear perspective view of panel 22 in FIGS. 1–3 and 13.

Shutter panel 20 (FIGS. 1, 2 and 3) comprises a shutter body consisting of a plurality of parallel angulated slats 40 interconnected by a central strengthening rib 42. A pair of flat parallel runners 44, 46 are integrally joined to opposite ends of the several slats 40 and project forwardly and rearwardly of the slat edges so as to be adapted to be slidably received into the longitudinal tracks formed by channels 32, 34 extending lengthwise along the opposing inside walls of side rails 12, 14. Likewise, shutter panel 22 (FIGS. 1–3) comprises a central shutter body consisting of a contoured front wall 48 with integral strengthening ribs 50 (FIG. 2), and a pair of flat parallel runners 52, 54 integrally extending along opposite side edges of wall 48. Runners 52, 54 project forwardly and rearwardly of wall 48 so as to be adapted to be slidably received within the tracks formed by channels 32, 34 in side rails 12, 14. As best seen in FIG. 13, ribs 50 project rearwardly of panel wall 48 so as to be coplanar with the rear edges of flanges 28, 30 in assembly with side rails 12, 14.

Figure 7:
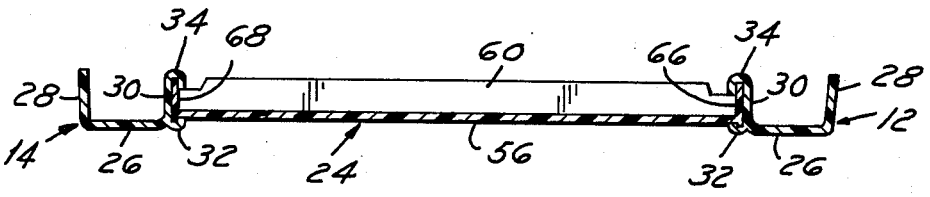

Mullion 24 (FIGS. 1–3 and 7) comprises a flat front wall 56 having a pair of rearwardly projecting flanges 58, 60 extending along the upper and lower edges of front wall 56. As can best be seen in FIG. 2, flanges 58, 60 function to separate shutter panels 20, 22 from each other in assembly. Front wall 56 projects upwardly and downwardly of flanges 58, 60 in the form of lips 62, 64 extending entirely across mullion 24. A pair of flat parallel runners 66, 68 extend along the laterally spaced side edges of mullion 24 and project forwardly and rearwardly of mullion 24 and project forwardly and rearwardly of mullion front wall 56 so as to be adapted to be slidably received in the tracks formed by side wall channels 32, 34. The lateral ends of support flanges 58, 60 are notched, as best seen in FIG. 7, so as not to interfere with rear channels 34.

Figure 3:
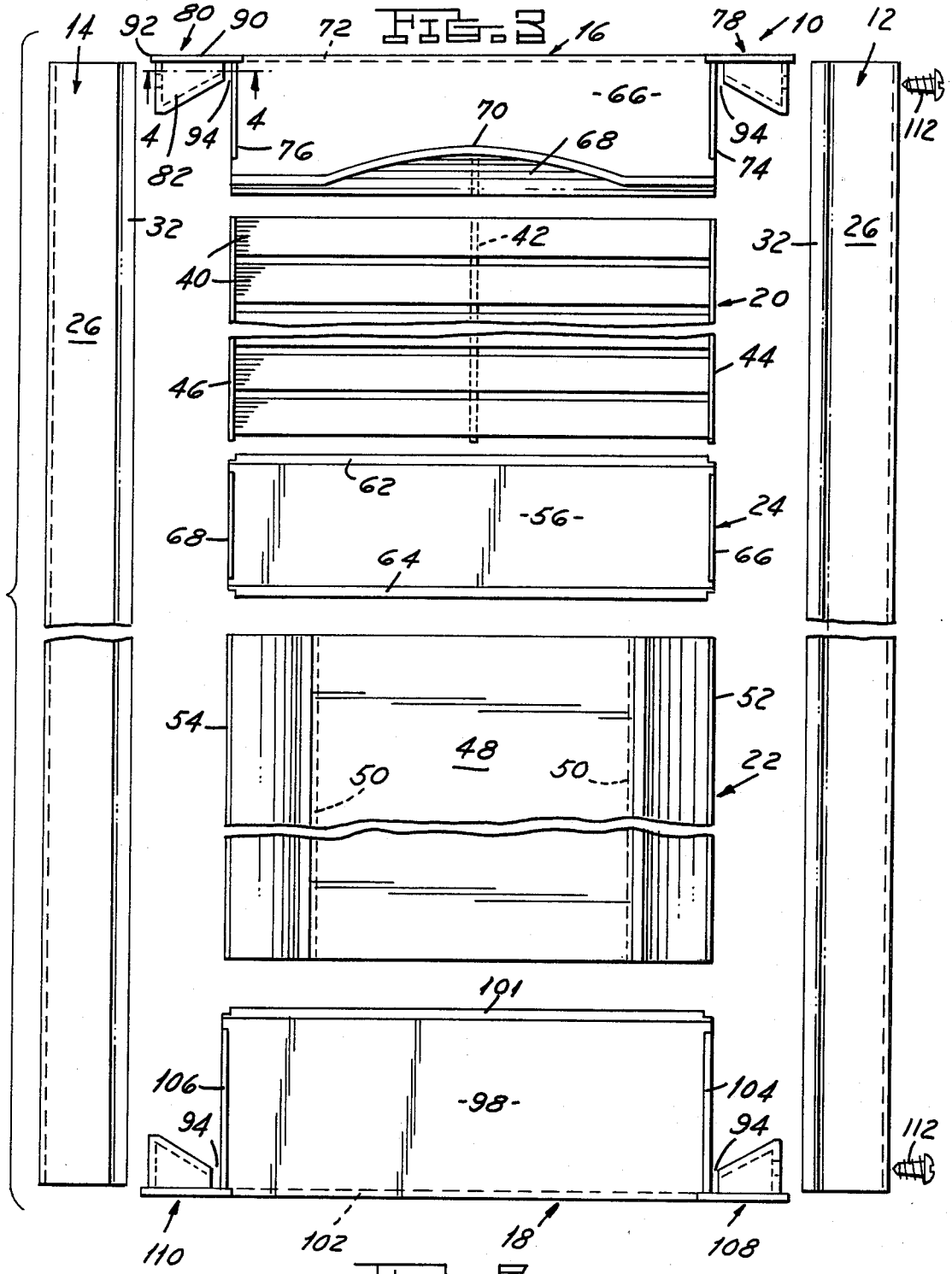
FIG. 3 is an exploded front elevational view of the shutter illustrated in FIG. 1.

Upper end rail 16 comprises a front wall 66 having a flat upper edge and a lower edge in the form of a single slat 68 coupled to a wall edge 70 of so-called cathedral contour. A flange 72 projects integrally rearwardly from the upper edge of front wall 66. A pair of flat parallel runners 74, 76 integrally extend along the side edges of front wall 66 and project forwardly and rearwardly therefrom so as to be adapted to be slidably received within the tracks formed by side rail channels 32, 34. A pair of hollow wings 78, 80 integrally project from side rails 74, 76 adjacent flange 72 for affixing upper rail 16 to side rails 12, 14. As best seen in FIGS. 3, 4 and 8, wing 80 comprises a generally hollow structure having a front wall 82, an outer side wall 84 and a lower wall 86 sloping away from the upper edge of end rail 16 from adjacent runner 76 to the juncture with side wall 84. The upper surface or wall 88 of wing 80 is contiguously integral with end rail flange 72, and projects forwardly of wing front wall 82 and laterally outwardly of wing side wall 84 in the form of lips 90, 92.

Wing front wall 82 is spaced from side rail 76 by a slot 94 which extends up to top wall 88 for receiving channel 32 of side rail 14 when end rail 16 is mounted thereto with wing 80 received internally of the side rail. As best seen in FIG. 4, slot 94 is formed in wing front wall 82 which is otherwise coplanar with the forward edge of runner 76. The forward edge of runner 76 extends up to lip 90, as best seen in FIG. 8. Wing 78 is the mirror image of wing 80 described in detail hereinabove.

Lower end rail 18 (FIGS. 1–3 and 6) comprises a front wall 98 from the upper and lower edges of which a pair of flanges 100, 102 integrally and rearwardly project. As best appreciated with reference to FIG. 2, flange 100 forms a support for shutter panel 22. Flange 102 forms a lower end rail wall. Front wall 98 projects beyond flange 100 as a lip 101. A pair of flat parallel runners 104, 106 extend integrally along the lateral side edges of lower rail front wall 98 and project forwardly and rearwardly therefrom so as to be adapted to be slidably received within the side rail tracks formed by channels 32, 34. A pair of wings 108, 110 project laterally outwardly of lower end rail runners 104, 106 and are adapted to be received internally of the lower ends of side rails 12, 14. Wing 108 is identical to wing 80 previously described in detail. Wing 110 is identical to wing 78, and is thus a mirror image of wing 80. Plastic fasteners 112 are received in aligned openings in the side rail outer walls 28 and the wing outer walls 84 for firmly holding the wings and end rails in assembled position.

Most preferably, each of the side rail, end rail, shutter panel and mullion elements hereinabove described is formed of integral molded plastic construction. Side rails 12, 14 may be formed in an extrusion operation and cut to desired basic lengths, such as lengths in multiples of one foot. Shutter panels 20, 22 mullion 24 and end rails 16, 18 may be formed in respective injection molding operations. Shutter panels 20, 22 specifically may be molded and then trimmed in the factory to standard lengths such, as one foot lengths, for packaging purposes. Preferably, the surfaces of all shutter elements which are exposed for viewing in use are suitably embossed so as to simulate a woodgrain appearance. The shutter elements may be formed of polystyrene, and preferably painted or coated both for pigmentation purposes and to filter or screen solar ultraviolet radiation which may cause fading or structural deterioration of the plastic material.

In the field, that is at the installation site, shutter side rails 12,14 and shutter panels 20,22 if necessary, may be trimmed as desired so as to provide a shutter assembly of overall length suited to the size of the door or window next to which the shutter is to be mounted. More specifically, side rails 12,14 are cut to length. Louvered shutter panel 20 may be trimmed using a handsaw or snips by cutting center support rib 42 and side runners 44,46 to the desired length. Solid shutter panel 22 may be trimmed using a hand or sabersaw by cutting across the width of the shutter panel. Scribe lines 200 (FIG. 14) may be formed on the back surfaces of all elements at the factory at predetermined separation, such as one inch, to facilitate trimming. Preferably, the fastener-receiving openings in side rails 12,14 and wings 78, 80,108,110 are formed at the installation site after the trimming and assembly operation to insure proper alignment.

With the shutter elements so trimmed to length, the shutter may be assembled by sliding the shutter panels and mullion strip (if desired) onto the side rails 12,14 as previously described. End rails 16,18 are then fitted onto opposite ends of the side rails by sliding the end rail runners into the side rail tracks and fitting the hollow body of the end rail wings into the open side rail ends. The fastener openings are then formed and fasteners 112 are inserted. In accordance with an important feature of the present invention, the forwardly and laterally projecting lips 90,92 (FIGS. 3–6 and 8) of wings 78,80,108 and 110 overlap the trimmed edges of side rails 12,14, and thus protect the side edges exposed during the trimming operation from the previously-mentioned deleterious effects of solar ultraviolet radiation. The provision of a forward wall 82 on each wing insures a pleasing appearance at each side railend rail junction even if the side rails are not neatly trimmed. Likewise, and as best appreciated with reference to FIG. 2, the lips 62,64 on mullion 24, and the upwardly projecting lip 101 on lower end rail 18, overlap and thus protect edges of shutter panels 20,22 which may have been exposed during the trimming operation, and also hide poorly trimmed edges. Mullion lip 64 and panel lip 101 also prevents panel 22 from bowing outwardly in assembly. As previously indicated, the rearward edges of ribs 50 on solid panel 22 are coplanar in assembly with the rearward edges of side rails 12,14. The ribs 50 will thus abut the wall surface on which the shutters are mounted and prevent panel 22 from bowing inwardly.

Figure 12:
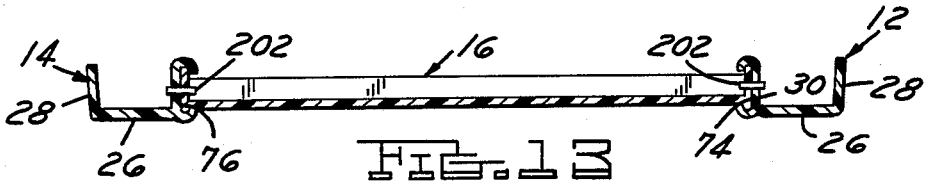
FIG. 12 is a plan sectional view showing a modified embodiment of the invention.
Figure 15:
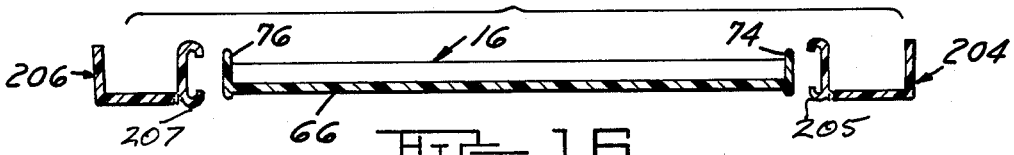
FIGS. 15 and 16 are sectional plan views illustrating another modified embodiment of the invention.
Figure 16:
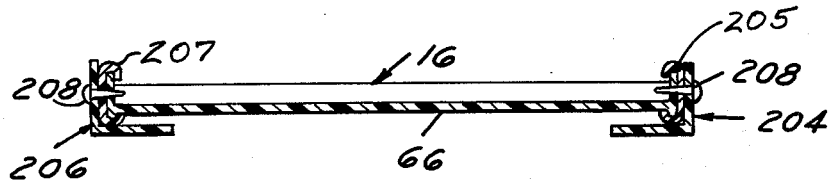

A modification is illustrated in FIG. 12 wherein the plastic fasteners 112 are replaced by staples 202 or the like extending through side rail wall 30 and end rail runners 74,76 (and 104,106). FIGS. 15 and 16 illustrate another modification wherein a pair of side rails 204,206 are identical with side rails 12,14 with the exception that the respective inner flanges and tracks 205,207 are cut off or otherwise removed and fitted separately over the panel runners. Each side rail 204,206 is thus generally L-shaped in axial cross section, and is assembled over the tracks 205,207 to the end rail 16, and to end rail 18, panels 20, 22 and mullion 24 (not shown) by the fasteners 208. The modification of FIGS. 15 and 16 finds particular utility in applications which may accommodate only limited-width shutters. In yet another modification, the scribe lines 200 illustrated in FIG. 14 may be scored to a substantial depth, so that the panels and rails may be adjusted to length in the field by bending and snapping each piece along the appropriate score lines.

The invention claimed is:

1. An adjustable length shutter assembly of molded plastic modular construction comprising a pair of side rails each including a front wall and spaced parallel integral inside and outside walls, a pair of opposed channels integral with said inside wall forming a double-channel track extending entirely along said inside wall, said side rails each having longitudinally spaced open ends with edges disposed in a plane, at least one shutter panel including a panel body and flat parallel runners integrally extending along side edges of said body, each of said runners projecting forwardly and rearwardly from said body and being adapted to be slidably received into a corresponding said doublechannel track so as to position said side rails in laterally spaced relation on opposite sides of said panel, upper and lower end rails each including a front wall, an end flange extending integrally along one edge of said end rail front wall, flat parallel runners integrally extending along side edges of said end rail front wall and projecting forwardly and rearwardly from said end rail front wall so as to be adapted to be slidably received in a corresponding said track, and a pair of integral wings projecting laterally outwardly from said end rail runners, each said wing including a body adapted to be received within a said second rail and a wall continuously integral with said end rail flange, said wing wall including a peripheral lip adapted to overlap said side rail end edges disposed in said plane, at least one of said end rail front walls projecting as a lip so as to overlap an opposing edge of said shutter panel body in assembly, fastening means consisting of staples received through said inside walls of said rails and through at least the said runners on said end rails.

2. An adjustable length shutter assembly of molded plastic modular construction comprising a pair of side rails each including a front wall and spaced parallel integral inside and outside walls, a pair of opposed channels integral with said inside wall forming a double-channel track extending entirely along said inside wall, said side rails each having longitudinally spaced open ends with edges disposed in a plane, a least one shutter panel including a panel body and flat parallel runners integrally extending along side edges of said body, each of said runners projecting forwardly and rearwardly from said body and being adapted to be slidably received into a corresponding said doublechannel track so as to position said side rails in laterally spaced relation on opposite sides of said panel, upper and lower end rails each including a front wall, an end flange extending integrally along one edge of said end rail front wall, flat parallel runners integrally extending along side edges of said end rail front wall and projecting forwardly and rearwardly from said end rail front wall so as to be adapted to be slidably received in a corresponding said track, and a pair of integral wings projecting laterally outwardly from said end rail runners, each said wing including a body adapted to be received within a said side end rail and a wall continuously integral with said end rail flange, said wing wall including a peripheral lip adapted to overlap said side rail end edges disposed in said plane, at least one of said end rail front walls projecting as a lip so as to overlap an opposing edge of said shutter panel body in assembly, each said wing body including a front wall and a side wall parallel to and spaced from the adjacent runner, said wing front wall being joined to said runner by a slot to receive a corresponding side rail channel, fastening means consisting of staples received through said inside walls of said rails and through at least the said runners on said end rails.

3. An adjustable shutter assembly of molded plastic modular construction comprising a pair of side rails each including a front wall and spaced parallel integral inside and outside walls, a pair of opposed channels integral with said inside wall forming a double-channel track extending entirely along said inside wall, said side rails each having longitudinally spaced open ends with edges disposed in a transverse plane, at least one panel including a panel body and flat parallel runners integrally extending along said edges of said body, each of said runners projecting forwardly and rearwardly from said body and being adapted to be slidably received into a corresponding track of said side rails, upper and lower end rails each including a front wall, an integral end flange extending along one edge of said end rail front wall, integral flat parallel runners along side edges of said front wall of said end rail and projecting forwardly and rearwardly from said front wall of said end rail so as to be adapted to be slidably received in a corresponding track of said side rails, and a pair of integral wings projecting laterally outwardly from said end rail runners, each said wing including a hollow body adapted to be received in an end rail.

4. The adjustable shutter set forth in claim 3 wherein each said hollow wing body comprises an end wall integral with said flange of said end rail, a front wall, an outside side wall and a lower wall.

5. The adjustable shutter set forth in claim 4 wherein said lower wall slopes away from the upper edge of the end rail to the side wall of the hollow wing body.

6. The adjustable shutter set forth in claim 4 wherein the front wall of each hollow wing body is spaced from the adjacent side rail to define a slot for receiving a channel of the side rail.

7. The adjustable shutter set forth in claim 4 wherein said end wall of each hollow body includes an integral lip adapted to overlie the edge of the front wall of the associated side rail and an integral lip adapted to overlie the edge of the outside wall of the associated side rail.

8. The adjustable shutter set forth in claim 3 wherein each said hollow body includes an integral lip adapted to overlie the edge of the front wall of the associated side rail and an integral lip adapted to overlie the edge of the outside wall of the associated side rail.

9. The adjustable shutter set forth in claim 3 including a second panel including at least one panel including a panel body and flat parallel runners integrally extending along side edges of said body, each of said runners projecting forwardly and rearwardly from said body and being adapted to be slidably received into a corresponding track of said side rails and a mullion panel adapted to be interposed between said panels and comprising a front wall, spaced integral parallel upper and lower flanges projecting rearwardly from said front wall, and spaced integral parallel runners extending along side edges of said front wall and adapted to be slidably received in the tracks of said rails, said front wall projecting in the general plane thereof beyond said upper and lower flanges to form mullion lips for overlapping an opposing edge of said shutter panel.

10. The adjustable shutter set forth in claim 9 wherein said panel body of said at least one panel comprises a contoured front wall with the runners thereof projecting forwardly and rearwardly of the side edges of said contoured front wall.

11. The adjustable shutter set forth in claim 10 wherein said end rail adjacent said panel having said contoured front wall has an integral lip extending from the front wall of the end rail generally in the plane of the front wall and adapted to overlie the contoured front wall of said second panel.

12. The adjustable shutter set forth in claim 3 wherein said panel body of said at least one panel comprises a contoured front wall with the runners thereof projecting forwardly and rearwardly of the side edges of said contoured front wall, one said end rail having an integral lip extending from the front wall of said end rail generally in the plane of the front wall and adapted to overlie the contoured front wall of the panel.

13. An adjustable shutter assembly of molded plastic modular construction comprising a pair of side rails each including a front wall and spaced parallel integral inside and outside walls, a track associated with each said inside wall, said side rails each having longitudinally spaced open ends with edges disposed in a transverse plane, at least one panel including a panel body and flat parallel runners integrally extending along side edges of said body, each of said runners projecting forwardly and rearwardly from said body and being adapted to be slidably received into a corrseponding track of said side rails, upper and lower end rails each including a front wall, an integral end flange extending along one edge of said end rail front wall, integral flat parallel runners along side edges of said front wall of said end rail and projecting forwardly and rearwardly from said front wall of said end rail so as to be adapted to be slidably recieved in a corresponding track of said side rails, and a pair of integral wings projecting laterally outwardly from said end rail runners including a body adapted to be received within said side rail, said body having an end wall integral with the flange of said end rail, each said end wall of each said wing having an integral lip extending outwardly to overlie the edge of the front wall of the associated side rail and an integral lip extending outwardly to overlie the edge of the outside wall of the associated side rail.

14. An adjustable length shutter assembly of molded plastic modular construction comprising a pair of side rails each including a front wall and spaced parallel integral inside and outside walls, a track associated with each said inside wall, said side rails each having longitudinally spaced open ends with edges disposed in a transverse plane, at least one panel including a panel body and flat parallel runner integrally extending along side edges of said body, each of said runners being adapted to be slidably received into a corresponding track of said side rails, upper and lower end rails each including a front wall, an integral end flange extending along one edge of said end rail front wall, integral flat parallel runners along side edges of said front wall of said end rail adapted to be slidably received in a corresponding track of said side rails, and a pair of integral wings projecting laterally outwardly from said end rail runners including a body adapted to be received within said side rail, said body having an end wall integral with the flange of said end rail, each said end wall of each said wing having an integral lip extending outwardly to overlie the edge of the front wall of the associated side rail and an integral lip extending outwardly to overlie the edge of the outside wall of the associated side rail.

* * * * *